US006762549B2

(12) United States Patent
Hitzschke et al.

(10) Patent No.: US 6,762,549 B2
(45) Date of Patent: Jul. 13, 2004

(54) DISCHARGE LAMP FOR DIELECTRICALLY IMPEDED DISCHARGES WITH A ARRANGEMENT OF SUPPORT ELEMENTS

(75) Inventors: Lothar Hitzschke, München (DE); Frank Vollkommer, Buchendorf (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 127 days.

(21) Appl. No.: 10/110,723

(22) PCT Filed: Sep. 5, 2001

(86) PCT No.: PCT/DE01/03408

§ 371 (c)(1),
(2), (4) Date: Apr. 15, 2002

(87) PCT Pub. No.: WO02/27759

PCT Pub. Date: Apr. 4, 2002

(65) Prior Publication Data

US 2002/0163296 A1 Nov. 7, 2002

(30) Foreign Application Priority Data

Sep. 28, 2000 (DE) ..... 100 48 186

(51) Int. Cl.[7] ..... H01J 1/62

(52) U.S. Cl. ..... 313/493; 313/491; 313/484; 313/483

(58) Field of Search ..... 313/491, 493, 313/484, 483

(56) References Cited

U.S. PATENT DOCUMENTS

| | | | | |
|---|---|---|---|---|
| 5,233,262 A | * | 8/1993 | Lynn et al. | 313/113 |
| 5,461,279 A | | 10/1995 | Hasegawa | |
| 6,515,419 B1 | * | 2/2003 | Lee et al. | 313/582 |
| 2002/0163311 A1 | * | 11/2002 | Hitzschke et al. | 315/56 |

FOREIGN PATENT DOCUMENTS

| | | |
|---|---|---|
| DE | 198 17 480 | 9/1999 |
| JP | 07 335177 | 12/1995 |
| WO | WO 92/02947 | 2/1992 |
| WO | WO 00/42635 | 7/2000 |

* cited by examiner

*Primary Examiner*—Nimeshkumar D. Patel
*Assistant Examiner*—Holly Harper
(74) *Attorney, Agent, or Firm*—Robert F. Clark

(57) ABSTRACT

In the case of a quiet discharge lamp, support elements for supporting a top plate are provided, by comparison with a base plate, in larger numbers and in an alternating arrangement with individual discharge structures.

17 Claims, 4 Drawing Sheets

DISCHARGE LAMP FOR DIELECTRICALLY IMPEDED DISCHARGES WITH A ARRANGEMENT OF SUPPORT ELEMENTS

"This invention is a 371 of PCT/DE01/03408, filed Sept. 5, 2001."

TECHNICAL FIELD

The invention outlined in this application relates to discharge lamps, specifically to those in which dielectrically impeded discharges burn during operation. In such discharge lamps, which are frequently denoted as silent discharge lamps, discharges are generated in a discharge medium with the aid of a set of electrodes. Dielectric impediment is produced by a dielectric layer between at least a part of the electrode set and the discharge medium, this part consisting at least of the anodes when the distribution of the tasks of the electrodes is fixed.

BACKGROUND ART

The details relating to silent discharge lamps need not be set forth here, because they belong to the prior art. Silent discharge lamps have recently been given increasing attention because it is possible with the aid of a special pulsed mode of operation (U.S. Pat. No. 5,604,410) to achieve relatively high UV efficiencies that permit economic generation of visible light given the use of appropriate fluorescent materials. The invention relates both to UV radiators and to lamps with visible emission. Of particular interest in this case are flat discharge lamps which can be used, for example, for backlighting displays, monitors and similar devices. Such flat discharge lamps generally have a plate-like design, that is to say they have a base plate and a top plate which define a discharge space between them for the discharge medium. At least one of the plates must be designed for light emission, the top plate being considered here as at least partially transparent. Of course, the top plate can in this case bear a fluorescent material which is not itself transparent in the true sense.

Because of the flat design, problems with mechanical stability arise in the case of relatively large formats of the flat discharge lamps. Consequently, it has become established to use support elements between the base plate and top plate. These support elements connect the two plates and thereby shorten the bending length between the outer edges of the plates on the paths between the support elements. In the outer region, the plates are generally connected via a frame enclosing the discharge space, which is not denoted as a support element here, although it also connects the plates and has a supporting function. The number of support elements is determined by the requirements placed on the loadability in bending and in compression, as well as by the format of the lamp, of course.

DISCLOSURE OF THE INVENTION

The invention is based on the technical problem of specifying a silent discharge lamp of the type described at the beginning having an improved mechanical design.

The invention provides for this purpose: a discharge lamp having a base plate, a top plate for the light exit, which is at least partially transparent, a discharge space between the base plate and the top plate, for holding a discharge medium, an electrode set for producing dielectrically impeded, individual localized discharges in the discharge medium, a dielectric layer between at least one part of the electrode set and the discharge medium, and a multiplicity of support elements which produce a connection between the base plate and the top plate, characterized in that, apart from those at the edges of the discharge space, the individual discharge regions are surrounded by in each case substantially identical patterns of support elements.

The invention also relates to a display device with such a discharge lamp, for example to a flat display screen, a display or a similar device using LCD technology.

The essential idea of the invention resides in not, as in the prior art, using the support elements in as small a number as at all possible but, on the contrary, distributing a relatively large number of support elements over the surface of the flat discharge lamp. The inventors have verified that, given appropriately more frequent support, it is possible to use comparatively thin base plates and top plates such that it is possible to realize a substantial weight saving for the overall lamp. The overall weight of the lamp is, however, of substantial importance for many applications. Moreover, in the case of relatively light plates the mounting method and automatic mounting devices possibly required therefor can be rendered substantially more simple and less expensive. Lighter plates are, moreover, associated with lower thermal capacitances, so that thermal cycles can be traversed more quickly, thus further simplifying the production. Moreover, it is of course also possible to achieve improved stability with a larger number of support elements.

In this case, the support elements, which can themselves certainly be multipartite, but are preferably unipartite, are to be arranged in an assignment relating to individual localized discharges in the discharge space. It is firstly to be stated in this regard that the individual localized discharge structures have appeared with the already mentioned pulsed operating method even without this invention and were able to be permanently located by creating preferred sites on the electrodes. However, the invention is not restricted to lamps with such preferred sites. Rather, it transpires that the invention itself results in preferred locations between the support elements for individual discharges, so that for example conventional structures, for example nose-like projections on the cathodes, can also be less strongly pronounced. To the extent that individual discharge structures can be produced between the support elements according to the invention independently of the possible pulsed operating method, the invention also relates thereto.

To the extent that this application talks of individual discharges or discharge structures, these statements relate, strictly speaking, to regions prescribed by the design of the lamp, in particular of the electrodes and the supporting projections, in which such individual discharge structures can burn. Depending on the operating state of the lamp, however, variously extended discharge structures are also conceivable in this case within these regions. Thus, the regions need not necessarily be filled entirely with a discharge structure. Above all, the desire can be to influence the size of the discharge structures in conjunction with dimming functions of the lamp. The statements in this application therefore relate to the regions which can be filled to the greatest extent with discharge structures. To the extent that electrode structures are provided for fixing preferred positions of discharges, there will generally be a 1:1 correspondence with the discharge regions.

The assignment between supporting projections and individual discharge regions is to be present in the invention at least in so far as the individual discharge regions are respectively surrounded by identical patterns of directly adjacent supporting projections. This excludes, of course, discharge regions in the edge region of the discharge lamp, that is to say in the vicinity of the frame or the lateral closure of the discharge vessel. The aim in this case is to design the pattern of the directly adjacent supporting projections around a discharge region together with this discharge region so as already to homogenize the luminance here as far as possible. The relatively large number of supporting projections then does not play a disadvantageous role for the homogeneity (compare the above explanations on the overall design of the discharge lamp). Of course, individual supporting projections can be directly adjacent to more than one discharge region, and this will even be the rule. It is also preferred that the supporting projections for their part are surrounded as far as possible by the same pattern of directly adjacent discharge regions in each case.

Moreover, the assignment between support elements and individual discharge regions is intended in the invention preferably to be present to such an extent that it is possible to find a plane through the discharge space between the base plate and top plate and a direction in this plane along which the support elements and the discharge regions alternate. The alternating row need not be a row alternating directly one after the other (according to the pattern ababab . . . ). Also included is a row in which two support elements or two discharge regions occur regularly one after another as long as each support element and each discharge region has at least one discharge region or at least one support element as its neighbor (that is to say, for example, abbabbabb . . . or aabbaabb . . . )

They need not necessarily be strictly collinear in this direction of the alternating row, but can also be distributed in a somewhat zigzag fashion. It is preferred for a multiplicity of such rows which are parallel to one another to exist in this plane. It is also preferred for there to be in the plane a second direction which is not situated parallel to the first-named direction and along which there is likewise an alternating row of support elements and discharge regions. In this case, there is preferably both a set of parallel rows in the first direction and a further set of parallel rows in the second direction. Consequently, the overall result is a planar pattern of support elements and discharge regions of alternating design, for example a chessboard pattern.

Moreover, it is preferred in the above definition that the straight line along which the alternating row results connects the centers of directly adjacent discharge regions or discharge regions which are at most situated next but one or the centers of directly adjacent support elements or support elements situated next but one.

A further idea of the invention consists in no longer, as in the prior art, understanding the support elements as optical disturbances in an overall discharge structure that is otherwise designed as homogeneously as possible. Rather, according to the invention the aim is to regard the support elements in their now relatively large number as an integral component of the structure responsible for the final luminance distribution. Consequently, the overall structure of the individual discharge regions is optimized together with the support elements and the optical modifications effected by them. In this case, as long as they are surrounded by a sufficiently large number of discharge regions, regularly occurring shadings can in principle be compensated just as effectively by diffusers or other homogenizing measures as was the case conventionally for the few support elements used. Moreover, as explained in more detail further below, the support elements can, however, themselves also be used for homogenization, for which purpose they preferably consist of optically transparent material. The supporting projections can certainly also be provided with a fluorescent coating, but they can also (by contrast with the remainder of the top plate) be entirely or partially free from fluorescent material, for example be wiped free subsequently. They can additionally be brightened up thereby, because the unavoidable extinction of the fluorescent layer is eliminated. For the above reasons, the invention provides that the support elements and the individual discharges, apart from edge effects of the lamp, in each case have substantially identical surroundings, that is to say, for example, all the support points are surrounded by an identical pattern of directly adjacent discharge regions, or vice versa.

In the case of electrode sets with strip-shaped electrodes which, apart from local structures (preferred points for discharge regions), run more or less rectilinearly, it is preferred that the discharge regions on a respective side of a specific electrode strip are separated in each case by support elements, for example alternate in each case with support elements, that is to say support elements are provided in each case between the discharges. A particularly simple example is chessboard-like overall arrangements of support elements and discharge structures. The exemplary embodiments illustrate this, but also show a counter example.

Overall, consideration is preferably given to intermediate distances between directly adjacent support elements which are 30 mm or less. In the case of typical dimensions of discharge paths and transverse extents of individual discharge structures, optically favorable and very stable support element patterns can be formed in this region.

According to a further point of view of the invention, the support elements are designed as supporting projections in the sense of a unipartite component of the top plate, the outer contour tapering toward the base plate in at least one cutting plane perpendicular to the base plate. The invention is thereby delimited from conventional support elements which, in the relevant prior art normally had the form of glass balls separating the plates. The supporting projections, according to the invention, of the top plate can already be provided during the production of the top plate as a moulded element of the top plate, for example by thermoforming, pressing or another suitable shaping method. In principle, they can also be integrally moulded subsequently, although in this case they are to be designed in one piece with the top plate when the lamp is actually mounted, so that the previous substantial outlay for the positioning and fixing of separate support elements between the plates can be eliminated. The outlay on mounting would otherwise be substantial precisely with the large number of supporting projections according to the invention. However, by way of example, it can also be sensible for the purpose of fastening the supporting projections on the base plate to provide a connecting element—for example made from solder glass—between the base plate and the supporting projections.

An integral production with the top plate is, of course, most favorable in this case. An advantage of this unipartite design with the top plate by contrast with being an integral part of the base plate resides in that the contact between a supporting projection and a plate unavoidably produces certain shadows in the luminance distribution which can impair the homogeneity and must be compensated. According to the inventors' findings, this compensation is easier the further removed the contacts causing the shadows are removed from the light emitting side of the top plate. This holds, in particular, in the case of the use of diffusers and other homogenizing elements on the top side or above the top plate. The greater the distance from such homogenizing elements, the better the possibilities of optical resolution of the shadows. The already mentioned tapering contour of the supporting projections should occur in at least one cross-sectional plane, the cross sectional plane running perpendicular to the base plate. The perpendicular orientation is to be defined locally in the case of a non-planar base plate. Because of the taper, the supporting projection is narrower in the direction along the plates just above the base plate than it is further removed from the base plate. This taper preferably effects the entire height of the supporting projection. However, not all the existing supporting projections need necessarily be provided with the shape explained here.

These supporting projections that are slimmer in the region of the base plate at first exhibit relatively small shadow effects. In the case when the individual localized discharge structures are produced above the base plate, it is thereby possible also to keep a space free for the discharge structures by virtue of the fact that the latter can exist largely without being influenced by the supporting projections. The discharge structures can then be moved together with a way that is favorable for the homogeneity and be arranged with a high density with the aid of which high luminances can be generated. Finally, the tapering contour can also generate favorable optical properties of the top plate, something which will be described further in more detail. The favorable optical properties lead in the way already outlined at the beginning to the fact that the larger number of supporting projections contributes to the homogenizing as an integral component of the lamp design, and need not be understood as disturbance of a structure homogenized independently of the supporting projections.

In order to avoid additional shadings and to utilize possible positive optical effects of the supporting projections, the latter preferably consist of an optically transparent material. However, they can in this case be coated entirely or partially with a fluorescent material, as is also the case with the remaining top plate. The supporting projections and the remainder of the top plate preferably consist of glass.

The shaping of the supporting projections is preferably designed such that not only is a cross-sectional plane with a tapering cross section produced, but, moreover, there is also no cross-sectional plane in which the supporting projection widens too substantially in the direction of the base plate. When expressed in other words, this means that the outer surface of the supporting projections faces the discharge space of the base plate, in any case the important part of the outer surface. There can also be individual regions of the outer surface which run perpendicular to the base plate, but not over an important part of the circumference of the supporting projections. In this case, the outer surface extends from the base plate up to the top plate, and so there is no talk here of a small part region of the outer surface.

The outer surface of the supporting projection is intended to form, in relation to a plane that cuts the supporting projection and runs at least locally parallel to the base plate between the top plate and the base plate, an angle of preferably at least 120°, better at least 130° and, in the most favorable case, 140° or more, this angle being defined in a cutting plane perpendicular to said plane and in the direction of the base plate. The angle thus refers, as an obtuse angle, to an outer surface of the supporting projection tipped toward the base plate. With such oblique outer surfaces, space for the discharges can still be created in the vicinity of the underside of the supporting projection adjacent to the base plate, on the one hand, but on the other hand these oblique outer surfaces are important for possible optical functions of the supporting projections.

Specifically, when the supporting projections according to the invention are limited by the obliquely running outer surfaces described, through refraction of light impinging from the discharge space, or through appropriate alignment of the emission characteristics, of a fluorescent layer from the outer surface, they ensure an alignment of light into the core region of the supporting projections. It is thereby possible to counteract the shadows produced by the contact with the base plate.

Furthermore, together with a pattern, prescribed by the electrode structure, of individual discharges it is possible to undertake an optimization to a luminance that is as homogenous as possible in an overall design of the arrangement of supporting projections and of the discharge structure. In addition to the shading effect of the contact between the supporting projection and base plate, it has also specifically to be taken into account that the individual discharge structures typically burn not below, but between supporting projections. Consequently, the maxima of the UV generation are likewise situated between the supporting projections. As a result of the effect of optical deflection, the light can be brought partly from these regions into the regions of the supporting projections so as to produce a relatively homogenous luminance on the top side of the top plate. The aspect of the invention addressed here is brought out more vividly by the exemplary embodiments.

As already touched upon, the supporting projections are to taper in the direction of the base plate. It is optimal in this case when the supporting projections are as narrow as possible in the region of the contact with the base plate, the term "narrow" being measured in relation to the other dimensions of the supporting projection. "Narrow" is in this case a path forming a small fraction, for example less than ⅓, ¼ or ⅕ of a typical transverse dimension (along the plates) of the supporting projection, for example half the height of the discharge space. This narrowness should be present in this case in at least one direction, but preferably in two directions in the "local" plane of the base plate. In other words, it can be a linearly narrow or approximately punctiform contact surface.

Very generally, even in the case of somewhat larger bearing surfaces in relation to the base plate, the supporting projections can run substantially like ribs along the top plate, or be limited to small regions in relation to the dimensions of the plates. In the first-named case, it is the linear contact surfaces that are the general concern for narrow contact surfaces, while in the second case it is the approximately punctiform ones. The rib-like supporting projections can have specific stabilization functions, for example they can provide the top plate with an improved motability in bending in one direction. Furthermore, as will be explained in still further detail in the exemplary embodiments, they can also serve to separate specific regions in the discharge space from one another, in order to influence the discharge distribution. Thus, together with the electrode structure they can define preferred locations for individual discharges and separate individual discharges from one another along identical electrodes. On the other hand, the supporting projections limited locally in two directions in the plane of the plate offer the possibility of minimized shading effects, and are generally sufficient for the support function.

A preferred shape for locally limited supporting projections can therefore be formed by a cone or by a pyramid, in the case of which the vertex touches the base plate (and is in this case possibly somewhat flattened off or rounded). In principle, any desired basic shapes come into consideration for the cones and pyramids, that is to say surfaces limited with any desired curves, polygonal surfaces or mixtures thereof. However, it is largely supporting projections without edges, that is to say cones, that are preferred, because the edges can lead to certain irregularities in the light distribution. As already stated, an attempt is to be made to keep the contact surfaces between supporting projections and base plate as small as possible. Limits can exist in this case that are set by production methods (rounding in the case of glass shaping) or by the mechanical point loading of the base plate, so that rather than a supporting projection actually coming to bear "in a pointed fashion" against the base plate, there is a slight rounding or flattening off. As long as this rounding or flattening off is not of any substantial consequence in relation to the size dimensions of the supporting projection, the basic idea of the narrowness is not thereby impaired.

However, the preferred feature of the invention is to keep the contact surface between the supporting projection and the base plate as small as possible by virtue of the fact that it results only from bearing by touching. In other words, instances of bonding, solder glass and the like, which would necessarily enlarge the contact surface somewhat, are to be dispensed with as far as possible. For the rest, such additions usually have the disadvantage that they release gases upon heating during lamp production so that extensive pumping operations are required to keep the discharge medium pure. Production is substantially simplified if, in accordance with the invention, such substances are dispensed with. However, it is not excluded in the case of bearing by touching that the supporting projections can be pressed slightly into other layers that are required in any case, for example into reflection layers or fluorescent layers on the base plate. A similar statement can hold for a fluorescent coating of the supporting projections themselves.

This bearing purely by touching between supporting projections and base plate generally suffices for the targeted stabilization effect, because mechanical stresses pressing the plates away from one another do not occur, as a rule. This holds, in particular, for the case, which is of most interest technically in any case, in which the discharge lamp is operated with a discharge medium at low pressure. The supporting projections are then pressed against the base plate by the external overpressure.

Finally, in the case of this invention preference is given to such discharge lamps as are designed for bipolar operation, in the case of which the electrodes therefore function alternately as anodes and as cathodes. Owing to a bipolar operation, the discharge structures, which are inherently generally asymmetric, are superimposed on one another to form a symmetrical distribution on average over time, for which reason the optical homogenization can be further improved.

BRIEF DESCRIPTION OF THE DRAWINGS

A more concrete description of the invention is given below with the aid of the exemplary embodiments. Individual features disclosed in this case can also be essential to the invention in combinations other than those represented. Moreover, the individual features in the present description and that which follows relate to aspects of the device and of the method of the invention. In detail.

BEST MODE FOR CARRYING OUT THE INVENTION

Figure 1:
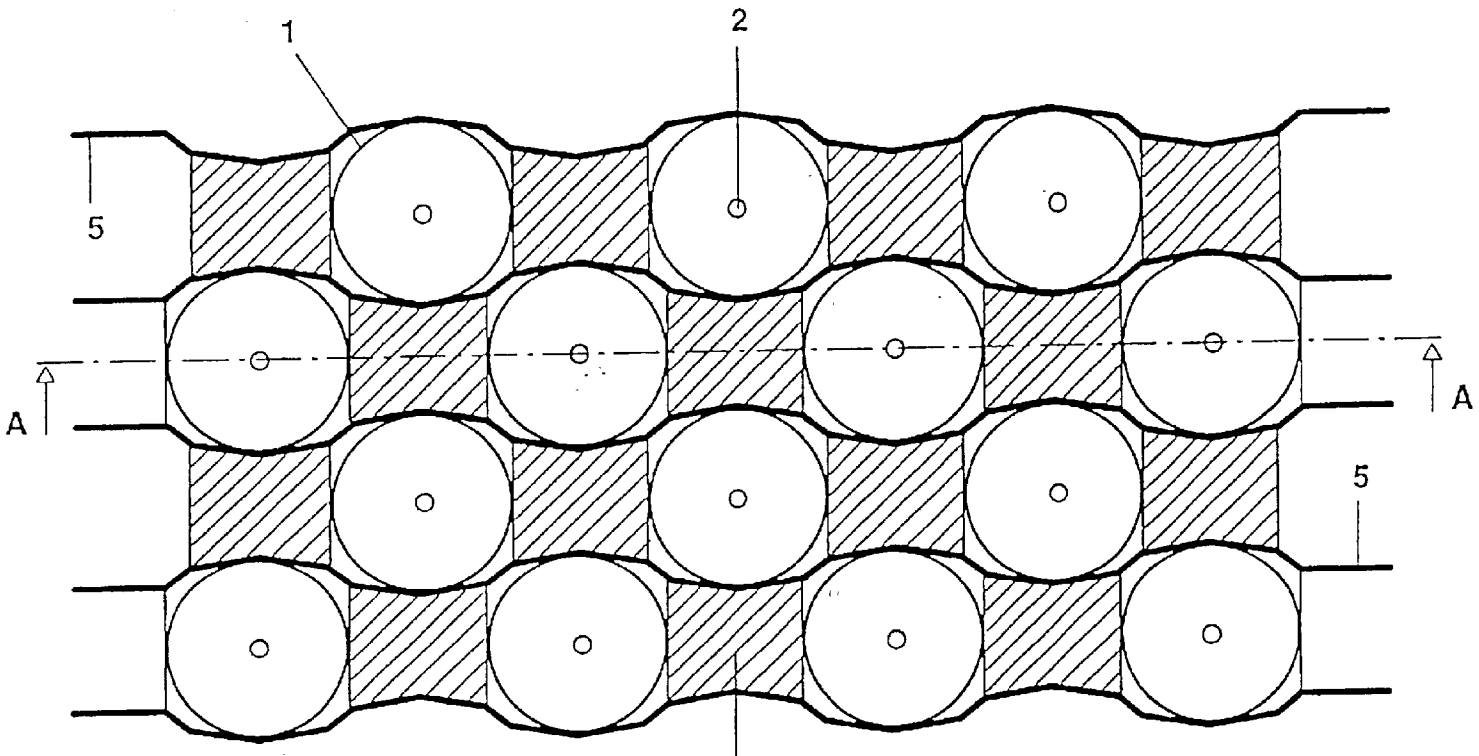
FIG. 1 shows a schematic plan view of an arrangement according to the invention of individual discharges and supporting projections.

FIG. 1 shows a schematic plan view of an arrangement of supporting projections and individual discharge regions that is like a chessboard. In this case, the circles denoted by 1 correspond to the circular shoulder of a supporting projection at the top plate 3 situated above in the cross-sectional view (A—A) in FIG. 2, which are represented as an edge in FIG. 2. The vertices of the conical supporting projections which point downward, that is to say toward the base plate 4, and therefore form the centers of the circles in FIG. 1, are denoted by 2.

In this exemplary embodiment, the top plate 3 is a thermoformed glass plate. The contour of the top side of the top plate 3 is therefore shaped largely like the underside of the top plate 3. However, this is not absolutely necessary. The top side of the top plate 3 could also be flat (or have different shapes). In addition to the points of view of the optical effect of the shape of the top plate 3, that is to say of the supporting projections, in particular, it is necessary in this case chiefly to consider criteria of favorable manufacturing capability.

Figure 2:
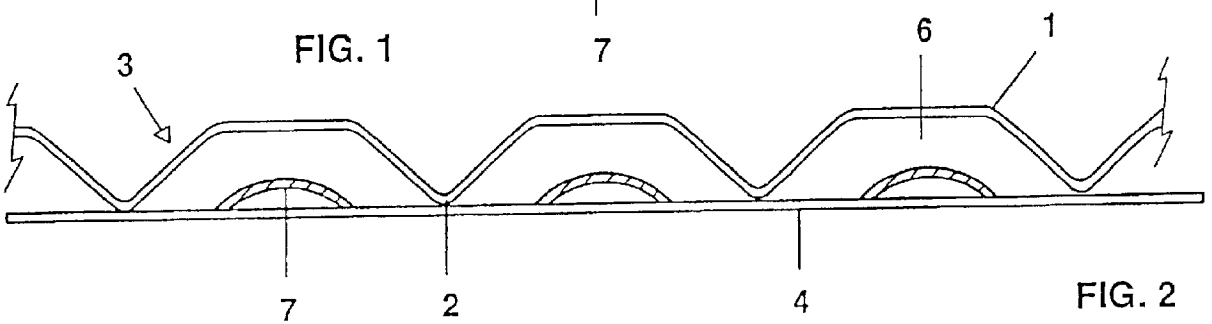
FIG. 2 shows a cross-sectional illustration of the arrangement of FIG. 1, along the line A—A in FIG. 1.

FIG. 2 shows that the thermoformed conical supporting projections have lateral surfaces running relatively flat. In fact, the vertical dimension is illustrated in an exaggerated way in FIG. 2, so that the supporting projections are actually even flatter than they are portrayed to be. They define with a horizontal line an angle (to be understood toward the base plate) of substantially over 120°, for example of over 130° or even over 140°. The angle between these lateral surfaces and the base plate is therefore small, that is to say is below 60°, and preferably even below 50° or below 40°. Denoted by 5 in FIG. 1 are electrode strips in the case of which there is no difference between anodes and cathodes, which are therefore all separated by a dielectric layer from the discharge space formed between the top plate 3 and the base plate 4. The discharge space is denoted by 6 in FIG. 2. The electrode strips 5 have shapes that run in the form of zigzags or waves and are composed of rectilinear path segments. Short path segments of the electrode strips 5 between directly adjacent supporting projections are inclined relative to the main strip direction and ensure separation of the discharge regions, which are denoted by 7 in FIGS. 1 and 2. If these segments were to be omitted, the discharge regions 7 would just touch. Between these oblique path segments, the electrode strips form indistinct saw tooth shapes in the vicinity of the discharge regions 7 themselves, the tip of the saw tooth being situated in the middle in each case. These electrode shapes are important for locating individual discharges in the region of the shortest discharge spacings, that is to say between corresponding projecting tips of the electrode strips 5. An individual discharge of variable extent which can also be divided into a plurality of discharge structures in some circumstances, will burn in each discharge region 7 in the case of this exemplary embodiment.

The exemplary embodiment illustrates that both the supporting projections 1, 2, on the one hand, and the discharge structures 7, on the other hand, are surrounded in each case by identical directly adjacent arrangements (the individual discharges 7 or the supporting projections 1, 2). Positions arranged only at the edge of the discharge lamps are excluded therefrom. It is to be seen that the line of section A—A illustrated in FIG. 1 runs alternately through supporting projections 1, 2 and discharge structures 7. The illustration in FIG. 2 corresponds to this. The rectangular chessboard-like arrangement produces here a simple arrangement with a multiplicity of neighboring directions of these alternating rows, specifically four horizontal rows and seven vertical rows in the detail, drawn in FIG. 1, of a relatively large lamp structure. It is to be seen in FIG. 2 that the individual discharge structures 7 could also reach in the case of other electrode shapes as far as into the region below the supporting projections 1, 2 of the top plate 3. This also holds, in addition, for a section (not illustrated here) along a vertical line running in FIG. 1 through the supporting projection tips 2. The individual discharge structures 7 are reproduced in FIG. 1 by shapes that are almost square. In fact, the individual discharges 7 can assume other shapes.

Figure 3:
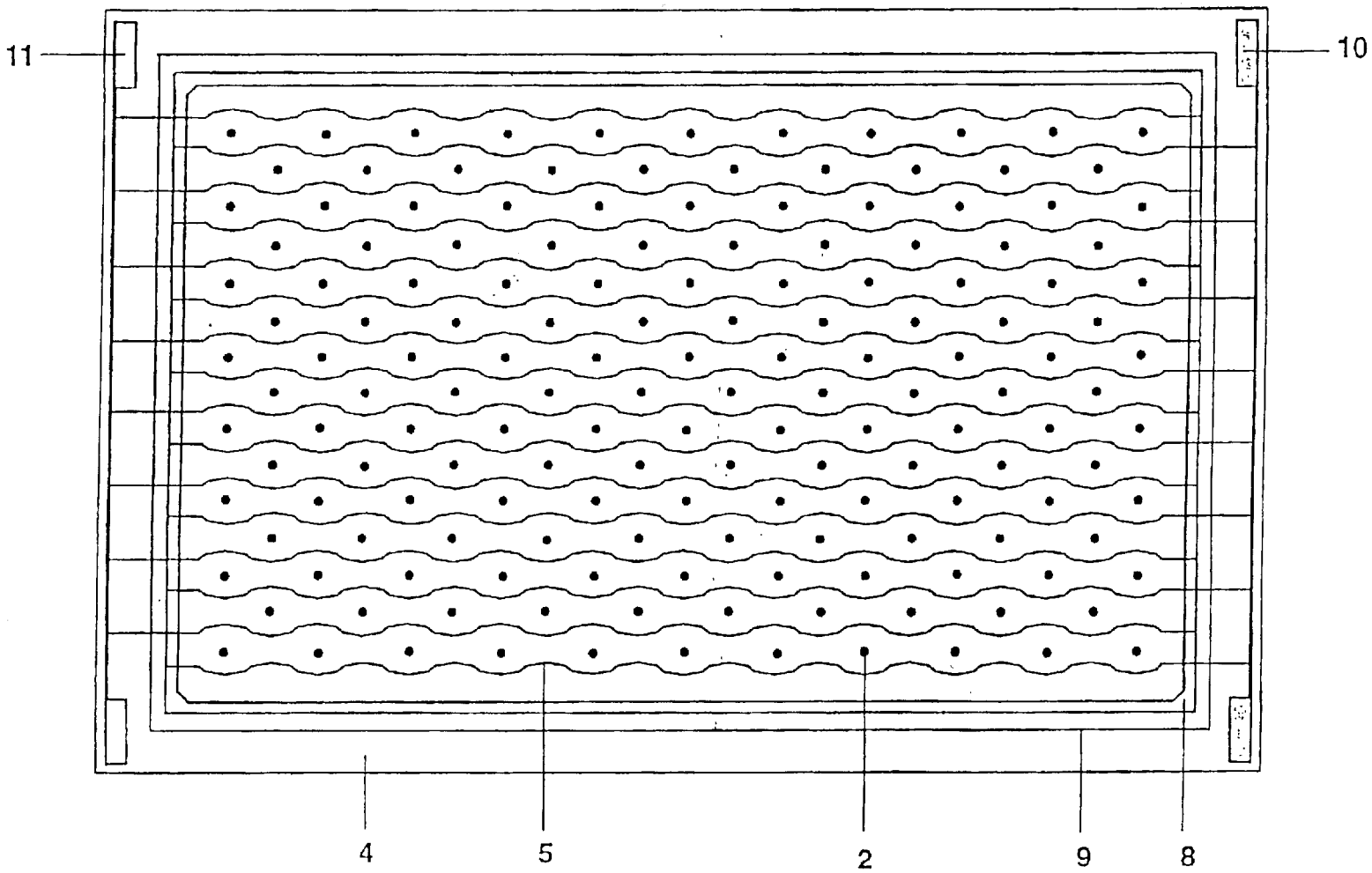
FIG. 3 shows a plan view of an electrode set of a discharge lamp according to the invention, with symbolized contact points of the supporting projections with the base plate, specifically according to the arrangement of FIGS. 1 and 2.

The electrode strips 5 illustrated here additionally have a course which, in addition to locally fixing the individual discharge structures, also exhibits good properties with reference to the dimming capability of the discharges, for which purpose reference is made to the two applications D 198 44 720 and DE 198 45 228. The dimming function is attended by a modification of the planar extent of the individual discharge structures 7, such that the latter can also be illustrated in a smaller fashion than in FIGS. 1 and 2. It is to be seen, moreover, that the discharge structures 7, which are arranged between the same electrode strips 5, are separated from one another by the supporting projections 1, 2. Because of the separating function of the supporting projections 1, 2 the zigzag shape of the electrode strips 5 in this exemplary embodiment is also only comparatively slightly in evidence, specifically with reference to the discharge spacing, that is to say the spacing between the electrode strips 5. FIG. 3 shows a plan view, corresponding to FIG. 1, of the base plate 4 with the set of electrodes 5. Illustrated here, however, is a complete discharge lamp in the case of which there are provided 21 vertical (in FIG. 3) and 15 horizontal (in FIG. 3) lines with respectively alternating rows of supporting projections 1, 2 and discharge structures 7. The plane of the base plate 4 is illustrated in FIG. 3, and so the supporting projections are shown only with their tips 2 in the approximate form of a point. For the sake of clarity, the discharge structures 7 are not illustrated, but are seated during operation of the discharge lamp as illustrated in FIGS. 1 and 2. FIG. 3 also shows that the electrode strips 5 are respectively alternately fed to a right-hand collective terminal 10 in FIG. 3 and a left-hand collective terminal 11 in FIG. 3, in order to be connected jointly thereby to an electronic ballast.

FIG. 3 also shows a frame-like structure 8 in the outer region of the base plate 4. Conventionally, use has been made here of glass frames separate from the base and top plates. In this exemplary embodiment, however, it is provided in a way similar to the design of the supporting projections 1, 2 that the "frame" 8 is likewise a projection of the top plate 3, not in the shape of a cone running down to a point, but as a rib. Here, the contact surface of the frame rib 8 with the base plate 4 has a certain width, because it is necessary there to provide a gastight connection between the top plate 3 and the base plate 4, for example by means of a solder glass. In addition, there are no disturbing shadow effects in this region, because it is in any case the edge at which the luminance is already decreasing.

Situated outside the frame rib 8 in FIG. 3 is, moreover, a line 9 which shows the limit of the frame.

The frame is bent up outside the rib 8. The electrode terminals (with bus structure) 10 and 11 illustrated outside, here, could also be accommodated in a protected fashion below the bent-up part. In addition, when dimensioning the frame rib 8 the thickness of the solder glass used for fastening must be taken into account with reference to the supporting projections, which only bear against it. The fluorescent coating is situated on the side of the top plate 3 facing the discharge space 6, that is to say on the underside of the top plate 3 in FIG. 2, and covers the top plate 3 completely inside the boundary illustrated in FIG. 3. The lateral surfaces of the supporting projections 1, 2 are therefore also covered with fluorescent material.

Figure 4:
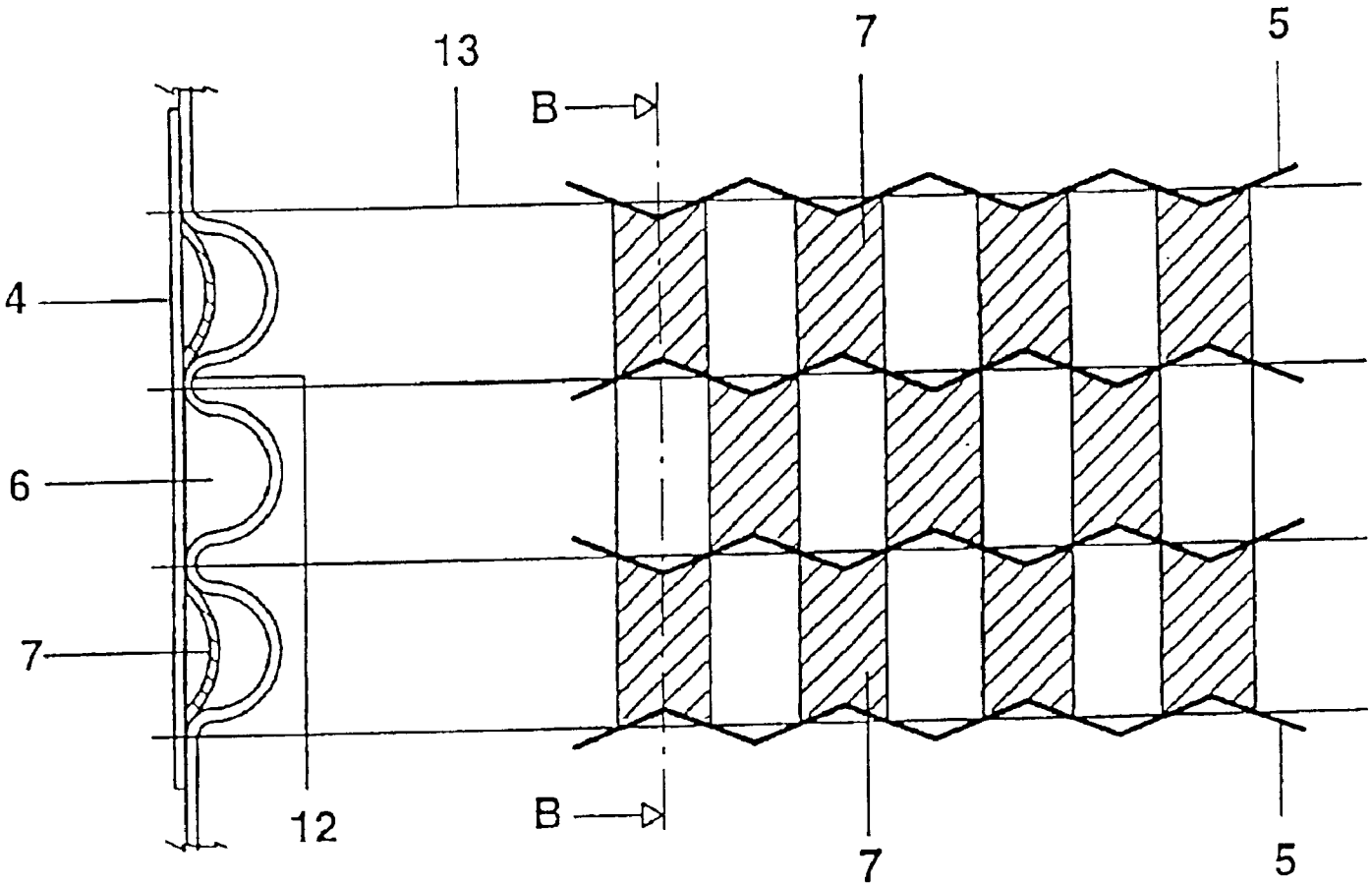
FIG. 4 shows an illustration, corresponding to FIG. 1, of a second exemplary embodiment.

FIG. 4 shows a variant of FIG. 1 as a second exemplary embodiment. In this case, the same reference numerals are used for corresponding parts. The difference from the first exemplary embodiment in FIGS. 1–3 consists in that the supporting projections have a ribbed nature, that is to say rest along a line. They are therefore denoted by 12 in this exemplary embodiment. It is shown by the auxiliary lines 13 that in this exemplary embodiment the supporting projections 12 bear in a linear fashion on the base plate 4 essentially above the electrode strips 5. The zigzag shape of the electrode strips 5 serves in this case to permit the electrode strips to look out alternately to the two sides below the respective supporting projection 12. Consequently, discharges 7 can burn between adjacent electrode strips, specifically precisely in the region of the electrode strips 5 that is not covered by the supporting projections.

In this exemplary embodiment, adjacent discharge structures 7 preceding from a specific electrode strip 5 to a specific side are therefore also separated in each case by supporting projections. This feature relates, specifically, to the fact that the discharge structures cannot converge to a single discharge structure. This is ensured in the present case by virtue of the fact that the supporting projections 12 cover the electrode strips 5 between such adjacent individual discharges 7 (twice). By contrast therewith, the convergence of adjacent individual discharge structures 7 in the case of the preceding exemplary embodiment had been achieved by the spatial arrangement of the supporting projections 1, 2 between the discharge structures themselves, that is to say between their centroids. In addition, this exemplary embodiment differs from the preceding one in that the supporting projections are of corrugated design in the cross-sectional profile shown on the left in FIG. 4, and in this case come into contact with the base plate 4 in a somewhat rounded way. Owing to this rounded form of contact, the function of the separation between the discharge regions along the same electrode strip 5 can be better observed. In addition, in this cross-sectional illustration the vertical dimension (in the direction of a perpendicular to the base plate 4) is also illustrated in an exaggerated way. In fact, the structures run flatter. However, the minimum angle of 120° already repeatedly mentioned above is not given over the entire height of the supporting projections in this exemplary embodiment. The middle region of the supporting projections actually runs somewhat more steeply. The upper region and the lower region are, however, in the preferred angular range.

Figure 5:
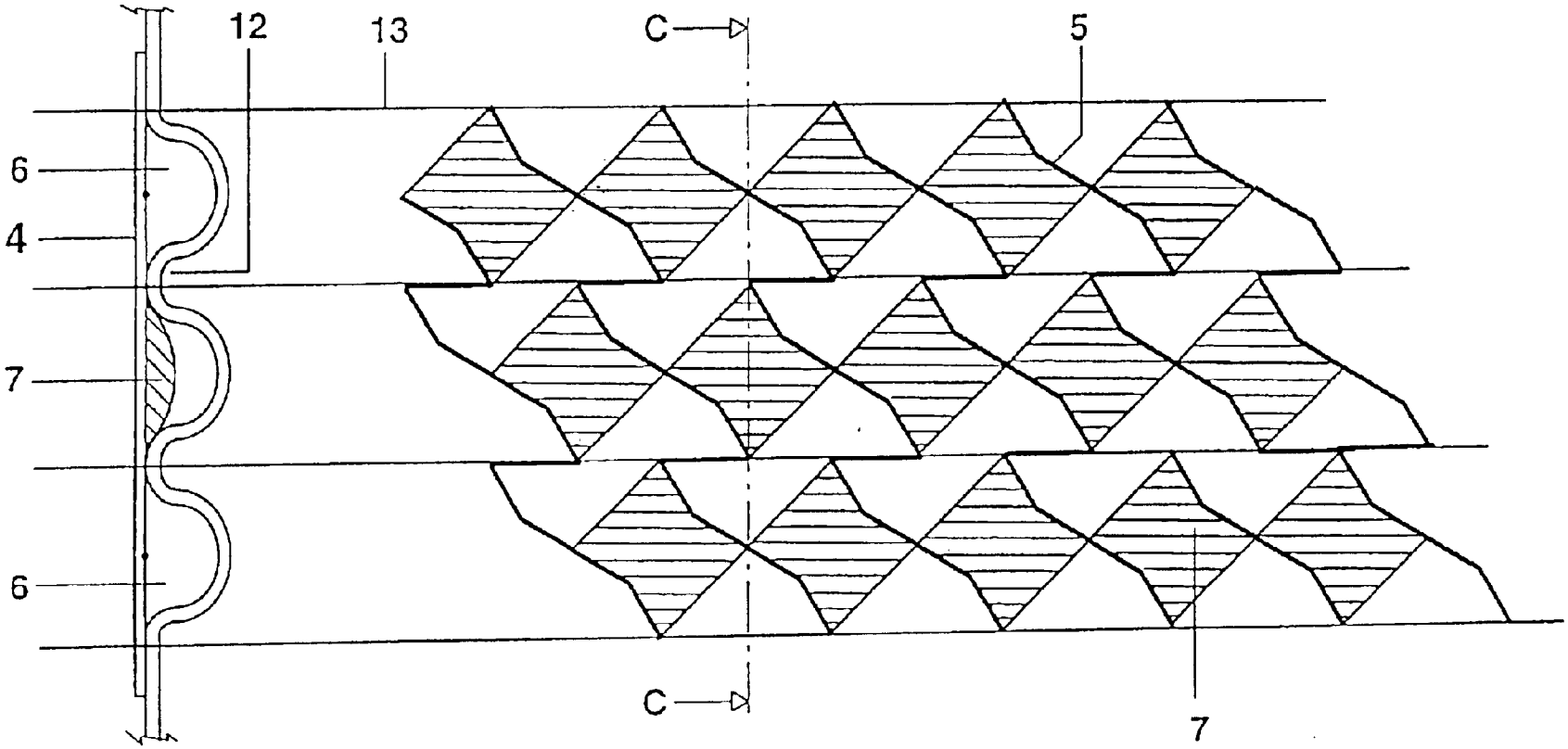
FIG. 5 shows an illustration, corresponding to FIGS. 1 and 4, of a third exemplary embodiment.

FIG. 5 shows a further exemplary embodiment. The lines drawn throughout with a stronger stroke represent electrode strips which are denoted, once again, by 5. Otherwise than in the first two exemplary embodiments, in this exemplary embodiment the electrode strips 5 have a shape that is slightly zigzagged, but otherwise continuously straight.

Rather, after a "saw tooth period" of the electrode strips 5 intermediate segments are provided that run obliquely backwards. These intermediate segments are situated in this case in parallel and below rib-like supporting projections 12 which correspond in addition to those of the second exemplary embodiment in FIG. 4. The courses are once again indicated with the aid of auxiliary lines 13 and illustrated in the left-hand lower region of FIG. 5 in a cross-sectional profile along the line C—C. In this case, as well, the rib-like supporting projections 12 touch the base plate 4 in a somewhat rounded fashion. As a result, discharges can be effectively avoided at the pieces of the electrode strips 5 that are situated in the contact region between the supporting projection 12 and the base plate 4. This is particularly important in this exemplary embodiment, because there occur along the direction of the supporting projections 12 spaces between directly adjacent electrode strips 5 that are shorter than at the points at which the discharge structures 7 are actually intended to burn. Consequently, this somewhat rounded (or alternatively somewhat planar) bearing of the supporting projections 12 on the base plate 4 is favorable in this exemplary embodiment in order to "block" specific parts of the electrode strips 5.

The vertical dimension is once again exaggerated in the sectional illustration. Here, as well, the actual structures are somewhat flatter. The statements relating to FIG. 4 hold for the angles defined by the supporting projections along their height. However, in the case of this embodiment the rounded lower regions of the supporting projections 12 are designed to be yet a little wider in order to be able to cover the corresponding segments of the electrode strips 5 effectively.

A field of individual discharges 7 that is very dense by comparison with the chessboard arrangements of the first and of the second exemplary embodiments results from the particular shape of the electrode strips 5. In the sectional illustration in FIG. 5, the individual discharge 7 illustrated is cut at an oblique angle. By comparison with the sectional illustrations of the discharges in FIGS. 2 and 4, it is therefore not raised from the substrate to the same extent. (As a rule, the invention deals not with surface discharges, but with discharges that burn in the volume of the discharge space and form arcs to some degree). In fact, however, in its middle region the discharge 7 is also spaced somewhat from the base plate 4, something which is no longer illustrated in the drawing. A common feature of all three exemplary embodiments is that a high degree of plate stability results from the arrangement of supporting projections that is exceptionally dense by comparison with conventional discharge lamps. Consequently, both the top plate 3 and the base plate 4 are of relatively thin-walled design. In addition, as illustrated in FIG. 3, it is provided in the exemplary embodiments that no separate frame is used between the base plate 4 and top plate 3. A drastically reduced outlay on mounting and substantially shortened processing times result from the unipartite design of the supporting projections with the base plate 3.

In addition, the supporting projections illustrated in the exemplary embodiments have shapes that are essential to the invention in each case. In all the exemplary embodiments, they extend from the top plate 3 toward the base plate 4 in a tapering way, the taper taking place in the case of the rib-like supporting projections from the second and the third exemplary embodiments transverse to the rib direction, in each cross-sectional plane perpendicular to the plates in the case of the conical supporting projections 1, 2 from the first exemplary embodiment. In this case, in the first exemplary embodiment angles of 40° occur between the base plate 4 and the lateral surfaces of the supporting projections, the lateral surface of the supporting projections continuing to face the base plate 4 overall. This implies an angle of 140° between the lateral surface and the plane, already explained above, that is parallel to the base plate and runs through the discharge space, this angle of 140° being defined facing the base plate.

When, as in these exemplary embodiments, the base plate 3 is coated together with the supporting projections 1, 2 and 12 with fluorescent material, the result of this is that the emission characteristics of the visible radiation are inclined so as to produce a brightening of the shadow caused by the contact with the base plate 4. Thus, light is reflected from the surroundings into the center of the supporting projection. It is also possible to provide by way of support in this case optically active structures on the top side or above the top plate 3. These optically active structures can be integrated in the top plate 3 or provided as a separate element.

Even when the top plate 3 is not coated with a fluorescent material, refraction of light at the lateral surfaces, obliquely facing the base plate 4, of the supporting projections 1, 2 and 12 would produce a similar effect. In this case, the supporting projections are respectively surrounded by an arrangement, as uniform as possible, of discharge structures 7. In the case of the first exemplary embodiment, this is the case because each supporting projection 1, 2 picks up light contributions from four discharge structures 7 distributed uniformly around it and, apart from the edge of the discharge lamp, the supporting projections 1, 2 do not differ therein. In the case of the second exemplary embodiment in FIG. 4, the supporting projection ribs 12 are supplied with light contributions stemming from discharge structures 7 on both sides, there being an addition homogenization owing to the alternating arrangement. The third exemplary embodiment in FIG. 5 is further improved to the extent that in addition to the alternating arrangement the discharge structures are situated more densely, thus producing more discharge-free regions.

What is claimed is:

1. A discharge lamp, comprising:

a base plate, a top plate which is at least partially transparent, a multiplicity of discharge spaces between the top plate and the base plate, the discharge spaces containing a discharge medium, dielectrically impeded electrode strips arranged on the base plate for producing localized discharge regions in the discharge medium, the top plate having a top side, an underside, and a multiplicity of unipartite supporting projections which bear against the base plate, the contour of the top side of the top plate being largely shaped like the contour of the underside of the top plate, and the electrode strips having a zigzag or a wave shape, the discharge regions and supporting projections being arranged in an alternating pattern.

2. The discharge lamp of claim 1 wherein the supporting projections are shaped liked cones or pyramids wherein the vertices of the cones or pyramids bear against the base plate.

3. The discharge lamps of claim 1 wherein the supporting projections and the discharge regions are arranged in a chessboard-like pattern.

4. The discharge lamp of claim 1 wherein the discharge regions and the supporting projections are arranged in multiple rows and each row has discharge regions and supporting projections which alternate in an ababab . . . pattern.

5. The discharge lamp of claim 1 wherein the discharge regions and the supporting projections are arranged in multiple rows and each row has discharge regions and supporting projections which alternate in an abbabbabb . . . pattern.

6. The discharge lamp of claim 1 wherein the discharge regions and the supporting projections are arranged in multiple rows and each row has discharge regions and supporting projections which alternate in an aabbaabb . . . pattern.

7. The discharge lamp of claim 1 wherein the electrode strips are comprised of rectilinear path segments.

8. The discharge lamp of claim 1 wherein the discharge regions and the supporting projections are arranged in a set of parallel rows in a first direction and a set of parallel rows in a second direction and each row has alternating discharge regions and supporting projections.

9. The discharge lamp of claim 1 wherein the top plate has a fluorescent coating and the supporting projections are at least partially free from fluorescent material.

10. The discharge lamp of claim 1 wherein the distance between directly adjacent supporting projections is 30 mm or less.

11. The discharge lamp of claim 1 wherein the supporting projections taper toward the base plate in at least one cutting plane perpendicular to the base plate.

12. The discharge lamp of claim 7 wherein the electrode strips have a saw tooth shape in the discharge regions.

13. A discharge lamp, comprising:

a base plate, a top plate which is at least partially transparent, a multiplicity of discharge spaces between the top plate and the base plate, the discharge spaces containing a discharge medium, dielectrically impeded electrode strips arranged on the base plate for producing localized discharge regions in the discharge medium, the top plate having a top side, an underside, and a multiplicity of unipartite rib-like supporting projections which bear in a linear fashion against the base plate, the contour of the top side of the top plate being largely shaped like the contour of the underside of the top plate, and the electrode strips having a zigzag or a wave shape, the discharge regions and supporting projections being arranged in an alternating pattern.

14. The discharge lamp of claim 13 wherein the electrode strips are partially covered by the supporting projections.

15. The discharge lamp of claim 14 wherein the supporting projections cover the electrode strips between adjacent discharge regions.

16. The discharge lamp of claim 13 wherein the electrode strips have a zigzag shape and intermediate segments which run obliquely backwards, the intermediate segments being parallel to and below the rib-like supporting projections.

17. The discharge lamp of claim 13 wherein the discharge regions are arranged in a chessboard-like pattern.

* * * * *